US005549280A

United States Patent [19]

Kings et al.

[11] Patent Number: 5,549,280

[45] Date of Patent: Aug. 27, 1996

[54] PROBE SYSTEM FOR RELIABLY MONITORING A CONDITION IN A METALLURGICAL PROCESS

[75] Inventors: Donald H. M. Kings, Bicester, England; Robin A. Sommers, Moon Township; John D. Usher, Beaver Falls, both of Pa.

[73] Assignee: Vesuvius Crucible Company, Wilmington, Del.

[21] Appl. No.: 467,990

[22] Filed: Jun. 6, 1995

[51] Int. Cl.[6] ..... C21D 11/00

[52] U.S. Cl. ..... 266/78; 266/98

[58] Field of Search ..... 266/99, 78; 340/509; 75/584, 582

[56] References Cited

U.S. PATENT DOCUMENTS

| | | | |
|---|---|---|---|
| 3,871,359 | 3/1973 | Pacela | 128/2.12 |
| 4,160,948 | 7/1979 | Tytgat et al. | 324/61 P |
| 4,342,633 | 8/1982 | Cure | 204/195 S |
| 4,413,917 | 11/1983 | Cooper | 374/173 |
| 4,498,044 | 2/1985 | Horn | 324/65 R |
| 4,724,376 | 2/1988 | Slough et al. | 324/64 |
| 5,063,937 | 11/1991 | Ezenwa et al. | 128/723 |
| 5,091,698 | 2/1992 | Grabs | 324/693 |
| 5,334,970 | 8/1994 | Bailey | 340/506 |
| 5,375,816 | 12/1994 | Ryan et al. | 266/44 |

OTHER PUBLICATIONS

Operation of EMF Oxygen Probes in a Copper Refinery, J. Dompas and J. Van Melle, International Conference on Copper and it's Alloys, Amsterdam, Sep. 21–25, 1970.

*Primary Examiner*—Scott Kastler

*Attorney, Agent, or Firm*—Sixbey, Friedman, Leedom & Ferguson

[57] ABSTRACT

A probe system for reliably monitoring a condition in a metallurgical process is provided which includes a probe having a circuit for generating a low DC voltage signal indicative of a condition in the metallurgical process, and an impedance monitoring circuit electrically connected to the probe circuit for passively and continuously measuring the impedance of the probe circuit to determine its reliability without disturbing its DC signal. The probe may be a slag detector, a thermocouple, a sulfur sensor, or an oxygen sensor of the type used in steel manufacturing processes. The impedance monitoring circuit includes an oscillator assembly and a known impedance that is serially connected to the probe circuit by means of coupling capacitors that prevent the conduction of potentially biasing DC currents through the probe circuit. A band pass filter circuit having an input is connected between the known impedance and the probe circuit for generating a residual voltage which, when compared to the voltage applied by the oscillator circuit, indicates the impedance of the probe circuit. The impedance monitoring circuit advantageously detects a failure condition in such probes even when the failed probe continues to generate a low DC voltage that spuriously indicates a normal operating condition.

22 Claims, 2 Drawing Sheets

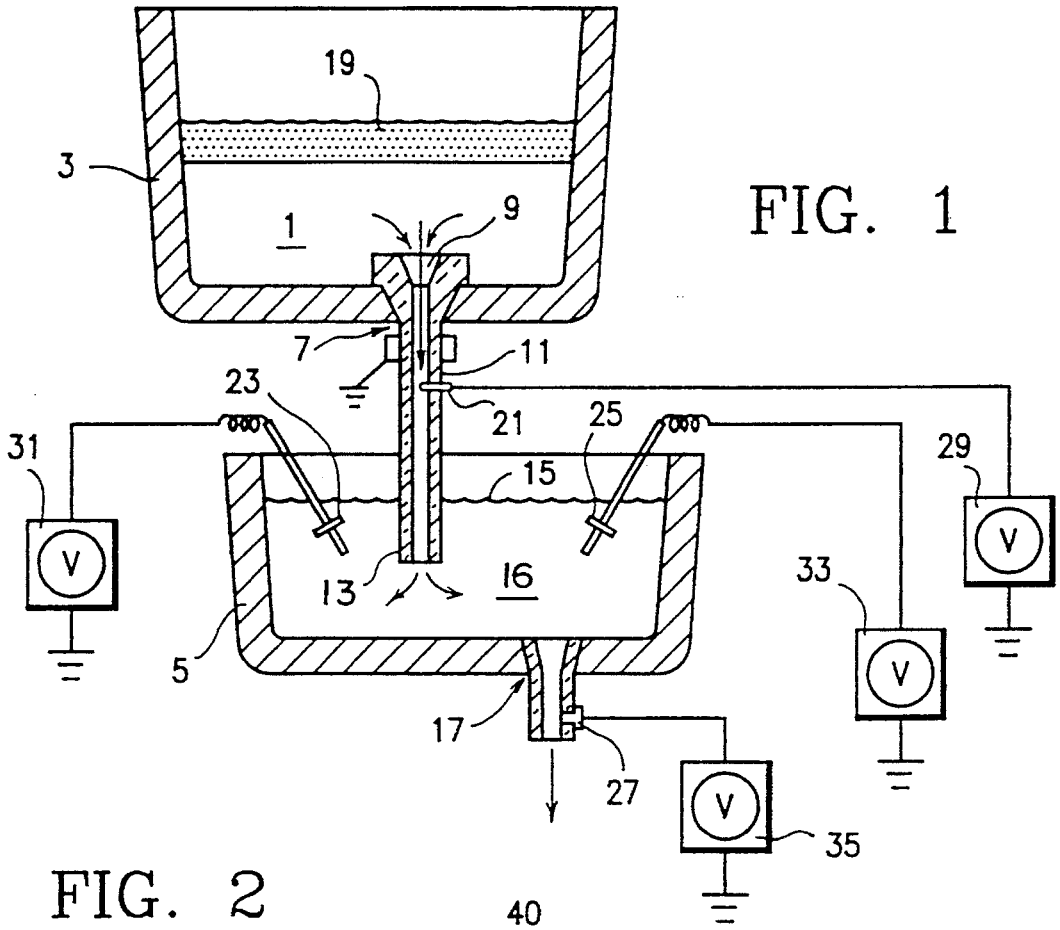
FIG. 1
FIG. 2
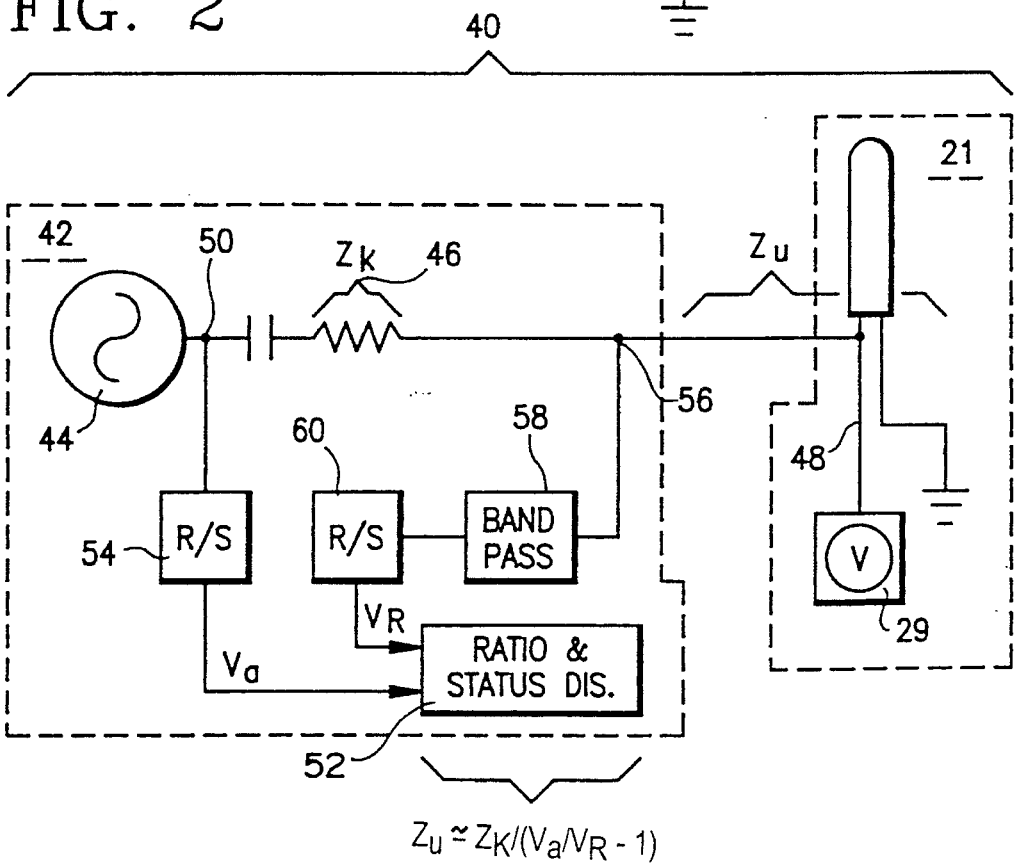

PROBE SYSTEM FOR RELIABLY MONITORING A CONDITION IN A METALLURGICAL PROCESS

BACKGROUND OF THE INVENTION

This invention generally relates to continuous sensors used in steel manufacturing and other metallurgical processes. Such sensors include slag detectors, thermocouples, and sulfur and oxygen probes that generate a DC output, and the invention is particularly concerned with the use of an impedance monitoring circuit in combination with such probes for determining the reliability of the probe signals.

Probes for monitoring various conditions in metallurgical processes such as steel making are known in the prior art. For example, a slag detecting sensor is known that detects the presence or absence of slag in a flow of molten metal by a coil of wire which generates a fluctuating magnetic field that interacts with the flow. More recently, a slag detecting sensor has been developed that comprises an insulated conductive pin that comes into direct contact with a flow of molten metal through a ladle shroud. Such a probe is disclosed and claimed in U.S. Pat. No. 5,375,816. The contact between the liquid metal and the electrically conductive pin creates a very small potential due to thermocouple effects. This DC voltage substantially increases upon the introduction of slag into the flow of molten metal due to the presence of charged particles in slag, which is believed to create an electrical double layer around the conductive pin. The electrical double layer in turn induces a substantial increase in the DC potential relative to ground of a few hundred millivolts. When such a pin is connected to a grounded volt meter, the resulting circuit has been found to provide a simple and reliable means for immediately detecting the presence of slag in a flow of molten metal such as steel.

In addition to slag detectors, thermocouple probes are often employed in such processes for continuously monitoring the temperature of the molten metals at various locations in the manufacturing facility. The sensor circuits of such thermocouple probes generally comprise a junction of dissimilar metals, such as platinum and rhodium, which generate low DC voltages when exposed to a sufficiently high temperature. Other types of probes used in metallurgical processes include sulfur and oxygen sensors for detecting the concentration of dissolved sulfur and oxygen in molten steels. Such probes are formed from a solid electrolyte encased in a heat-resistant shield. The shield protects the electrolyte from thermal shock, and ablates when the probe is immersed in molten metal. In operation, the conduction of the ions of sulfur or oxygen through the electrolyte generates a low voltage DC potential across the electrolyte whose magnitude is related to the solute activity in the molten metal.

While each of the aforementioned probes has demonstrated its utility in monitoring the particular condition it is designed for, problems can arise when the components in these probes either fail or begin to approach a break-down condition due to either mechanical or thermal shock, or a subtle electrical fault, such as a breaking (but not yet broken) conductor. The applicant has observed that such probes are capable of generating a low-voltage signal even in a failed or near failure condition. For example, probes such as the oxygen and sulfur sensors can still generate a voltage due to stray electromagnetic fields if their internal contacts should become broken. In instances where such a spurious voltage is within the range associated with the normal operation of the metallurgical process, they are dangerously misleading, as they provide a signal which may be completely false. Accordingly, there is a need for a way to determine whether or not an apparently normally functioning probe is in a failed or near failure condition.

In solving the aforementioned problem, the applicant has observed that the resistance of a probe in a failed or near failure condition changes to an extent to where the probe circuit resembles either a closed circuit (which may happen in the event of a short circuit) or an open circuit (which may happen in the event of a broken lead wire). Hence it is possible to test the reliability of the voltage signal generated by a probe by means of a simple DC resistance meter. However, such a solution has two major drawbacks. First, the imposition of a calibration voltage across a probe circuit alters the output signal of the probe, which in turn renders this approach incompatible with continuous monitoring. Consequently, such an approach would not be able to detect with any precision the exact moment of a failed or near failure condition, as the probe could only be intermittently monitored. Secondly, even the imposition of an intermittent DC voltage across the circuits of many of the aforementioned probes could result in unwanted polarization effects that could substantially distort the resulting output signals either temporarily or permanently. For example, if a calibration voltage were applied across the electrolyte present within a sulfur or oxygen sensor, the resulting potential could cause a maximum migration of the ions in the electrolyte, which could permanently ruin the reliability of any output signal subsequently generated by such a probe.

Clearly, there is a need for a way of determining whether or not the circuit of a particular metallurgical probe is in a failed or near failure condition which could continuously monitor the condition of the probe without altering its voltage signal output. Ideally, such a technique would not involve the application of any DC voltages to the components of the probe circuit which could result in unwanted polarizations in the interface between the probe sensor and the material being sensed. Finally, such a technique should be easy and inexpensive to implement, and readily applicable to the circuits of probes that are already in service.

SUMMARY OF THE INVENTION

Generally speaking, the invention is a probe system for monitoring a condition in a metallurgical process that comprises the combination of a probe having a circuit for generating a voltage signal indicative of a condition in a metallurgical process wherein the magnitude of the voltage signal varies with changes in the condition, and an impedance monitoring circuit electrically connected to the probe circuit for continuously generating a signal indicative of the impedance of the probe circuit to determine its reliability without disturbing the signal. The probe may be a slag detector of the type having an electrically conductive element in contact with a flow of liquid metal, a thermocouple for measuring the temperature of metal undergoing refinement, or a sulfur or oxygen probe of the type having an electrolyte for determining the concentration of these elements in molten metal. All of these kinds of probes generate a DC voltage signal that typically varies between 0.005 and 1.0 volts with the particular metallurgical condition that they are designed to sense. The impedance monitoring circuit continuously monitors the integrity of this low voltage signal by determining whether or not either an open circuit or a closed circuit condition is present across the probe which in turn would indicate a malfunction condition (i.e., a broken lead, a short circuit, etc.).

The impedance monitoring circuit measures the impedance of the probe circuit in a manner that does not disturb the voltage signal generated by the probe circuit. Such passive monitoring advantageously allows the impedance monitoring circuit to continuously check the integrity of the probe circuit signal without the need for switching off, or disconnecting, the probe circuit. To this end, the impedance monitoring circuit includes an oscillator assembly for generating a relatively high frequency, low voltage AC signal which can be superimposed over the low voltage DC signal of the probe circuit without altering the DC level of the signal. Additionally, the AC signal is coupled across the probe circuit by means of coupling capacitors that prevent any potentially signal biasing DC voltages from being applied across the probe circuit.

The impedance monitoring circuit may also have a known impedance that is serially connected between the oscillator assembly and the probe circuit whose impedance is to be monitored, as well as a band pass filter circuit having an input connected between the known impedance and the probe circuit for filtering out interfering frequencies, and generating a residual voltage that is dependent upon the impedance of the probe circuit. AC to DC convertors may also be included in the circuit for converting both the voltage applied by the oscillator assembly and the residual voltage generated by the band pass filter circuit into DC voltages whose ratio is indicative of the impedance of the probe circuit. Finally, the circuit may include a means for generating a signal indicative of the operating status of the probe.

The impedance monitoring circuit provides an inexpensive and accurate circuit capable of continuously monitoring the output of a probe circuit without disturbing its signal. Additionally, it can be easily retrofitted onto the circuits of probes already in service in shrouds, tundishes, or other metallurgical processing equipment.

BRIEF DESCRIPTION OF THE DRAWINGS

FIG. 1 is a schematized, cross-sectional view of a ladle and tundish used in a continuous steel casting operation with a slag detector, thermocouple, oxygen sensor, and sulfur sensor mounted therein;

FIG. 2 is a schematic circuit diagram of a slag detector in combination with the impedance monitoring circuit of the invention;

DETAILED DESCRIPTION OF THE PREFERRED EMBODIMENT

Figure 3:
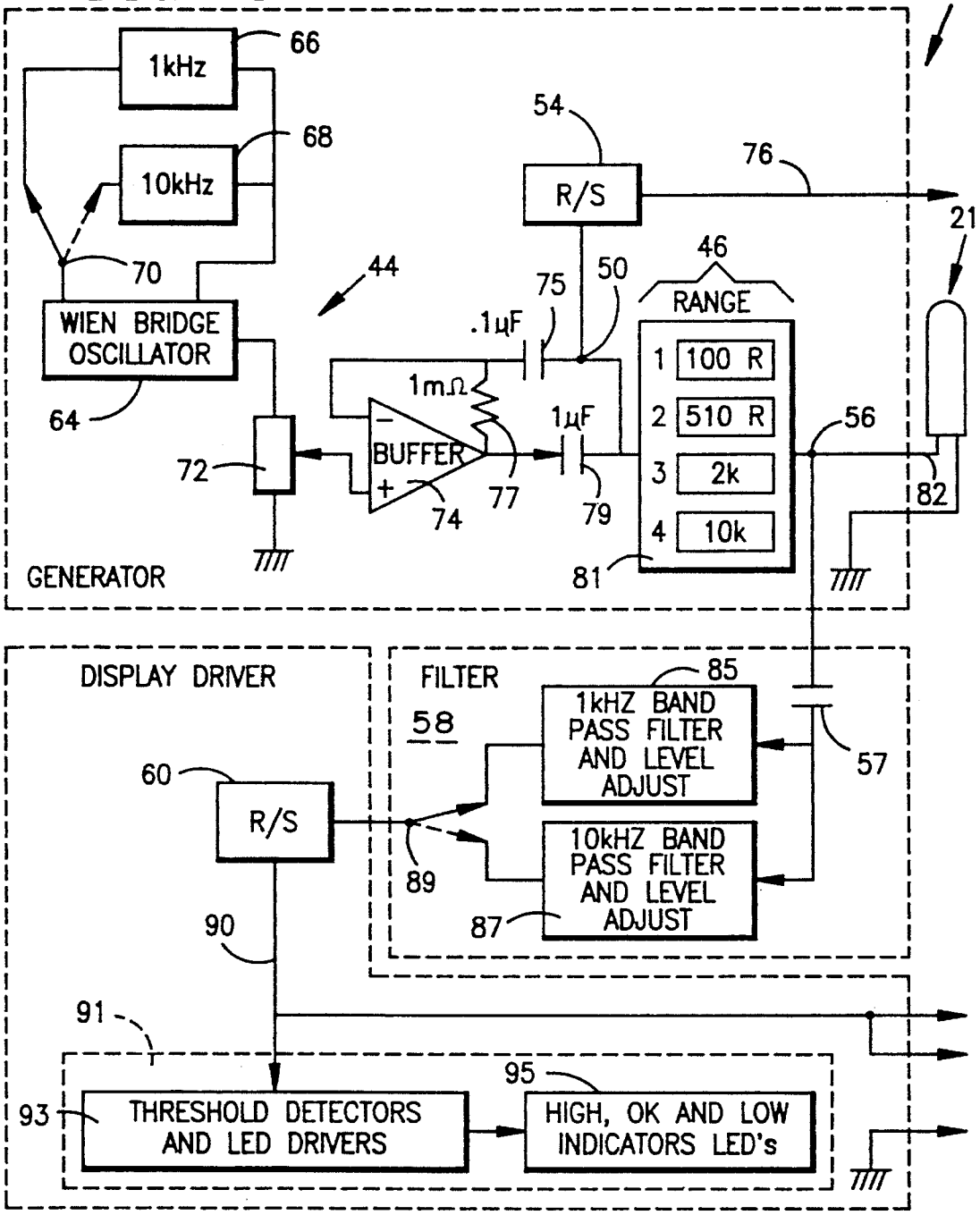
FIG. 3 is a detailed schematic diagram of a first embodiment of the impedance monitoring circuit of the invention.

With reference now to FIG. 1, the invention finds particular application in a continuous steel casting operation of the type wherein liquid steel 1 is contained within a ladle 3. In such a continuous casting operation, the refined steel 1 is continuously poured from the ladle 3 into a tundish 5 through a pour opening 7 which may be opened or closed by a slide gate valve (not shown). To prevent ambient oxygen from coming into contact with the flow 9 of liquid steel conducted from the ladle 3 to the randish 5, a tubular shroud 11 is provided whose lower end 13 is provided below the level 15 of steel in the tundish 5. Steel poured into the randish 5 is ultimately admitted through a pour opening 17 having a slide gate valve or stopper (not shown) for regulating the rate of flow of liquid steel into a continuous casting mold.

As a result of the previous refining processes that the steel 1 is subjected to in the ladle 3, a layer of slag 19 builds up over the upper surface of the steel 1. While such slag 19 often serves the useful purpose of drawing out unwanted impurities in the steel (such as sulfur) and further serves as a thermal insulator that helps keep the steel in a proper liquid form, it is also highly erosive. Hence, it is important that the level of the steel 1 in the ladle 3 be continuously monitored so as to ensure that no slag 19 will run into the randish 5. Such an unwanted flow of erosive slag would destroy the refractory lining (not shown) provided around the inner surface of the tundish 5, and would further contaminate the steel castings produced by the tundish 5.

In order to prevent these and other mishaps from occurring in such continuous casting operations, a plurality of probes such as a slag detector 21, an oxygen detector 23, a sulfur detector 25, and a thermocouple 27 may be mounted at various strategic points within the ladle 3, tundish 5, and shroud 11. The slag detector 21 comprises a conductive pin mounted in the wall of the shroud 11 for electrically contacting the flow 9 of liquid steel conducted through the shroud 11. It has been found that such a flow 9 of liquid steel induces a thermocouple voltage in the pin of the slag detector 21 relative to ground on the order of a 10 to 20 millivolts. This voltage is measured and monitored by means of a volt meter 29 that is electrically connected to the pin of the slag detector 21 as shown. If the level of steel 1 in the ladle 3 ever becomes so low that slag 19 begins to enter the flow 9 through the shroud 11, the measured voltage substantially increases to about 200 millivolts relative to ground. Such an increase in voltage is immediately indicated by the volt meter 29, which alerts the system operator to close the ladle gate valve. The oxygen probe 23 and sulfur probe 25 each include a solid electrolyte contained within a thermal shock shield. When the solid electrolyte of such probes is exposed to sulfur or oxygen ions, an electrical potential of several hundred millivolts is generated by the electrolytes within such detectors 23, 25 that is related to the activity of the oxygen or sulfur present in the metal. Such a potential can be easily detected and displayed by means of volt meters 31 and 33 as indicated. Finally, the thermocouple 27 comprises a pair of dissimilar metals joined at a junction and surrounded by a protective shield. When the junction of these metals (which may be, for example, platinum and rhodium) are exposed to high temperatures, they generate voltages of 10 to 20 millivolts which may likewise be easily detected and displayed by means of a volt meter 35.

Unfortunately, each of the aforementioned probes 21, 23, 25 and 27 is capable of generating a voltage even in a failed or near failure condition. When such spurious voltages are within the range of voltages associated with normal operating conditions in the metallurgical process being monitored, they are dangerously deceptive. Often, however, although the probes continue to generate an apparently valid output voltage, the impedance of the probes will vary in a manner that can be used to indicate a failure or near failure condition.

FIG. 2 illustrates a simplified block diagram of the probe system 40 of the invention that continuously monitors and displays the operative status of probes such as the previously discussed slag detector 21, oxygen detector 23, sulfur detector 25, and thermocouple 27 without interrupting or disturbing their output signals.

The system 40 generally comprises an impedance monitoring circuit 42 having an oscillator assembly 44 that generates an AC voltage. This AC voltage is connected at output tap 50 to a known impedance circuit 46 which in turn is serially connected to the input lead 48 of a probe circuit such as the previously described slag detector 21. In this manner, known impedance circuit 46 and slag detector 21 form a voltage divider across which the AC voltage generated by oscillator assembly 44 is divided.

The AC voltage of the oscillator assembly 44 is also connected at output tap 50 to a rectification and smoothing circuit 54, and a ratio and status display circuit 52. The rectified and smoothed voltage generated at the output of the rectification and smoothing circuit 54 is a DC representation of the voltage applied (Va) across the serially-connected known impedance circuit 46 (or Zk) and the circuit of the probe, such as slag detector 21. The DC voltage generated by the circuit of the slag detector 21 is essentially combined with the divided AC voltage generated by the oscillator assembly 44 and is tapped off at connection 56, where it is conducted through a capacitor 57 to remove the DC voltage generated by the slag detector 21 and a band pass filter circuit 58 that filters out all interfering frequencies that might be present in the combined signal. The resulting AC voltage is then converted into a DC voltage by means of a second rectification and smoothing circuit 60, which in turn generates a DC representation of the residual voltage, or Vr of the combined signal. This DC voltage Vr is likewise entered into the input of the ratio and display status circuit 52. The ratio and status display circuit 52 can then compute the unknown impedance (Zu) of the circuit of the slag detector 21 by the application of the formula $Zu \approx Zk/(Va/Vr-1)$. Circuit 52 could include a microprocessor or other circuitry programmed to display the impedance of the slag detector, or to display that the slag detector 21 (or other probe being monitored) is inoperative if the measured impedance is either so high or so low as to indicate either an open or closed circuit condition.

FIG. 3 is a more detailed schematic diagram of a preferred embodiment of the impedance monitoring circuit 42 of the invention. Circuit 42 includes an oscillator assembly 44 comprising a Wien bridge oscillator 64 capable of generating sinusoidal AC voltage having a frequency of either 1 kilohertz or 10 kilohertz. The frequency selection is accomplished by a pair of calibrated impedance circuits 66, 68, either of which may be selectively incorporated into the oscillator circuit 64 by means of a selector switch 70. While it is possible to have an impedance monitoring circuit 42 having an oscillator assembly capable of generating a single frequency, a dual frequency capacity is preferred since the probe 21 could be mounted in an electrically-noisy environment, such as an induction furnace, where a component of the ambient electrical noise could correspond to the single operating frequency of such an oscillator assembly. Additionally, operating frequencies of 1 and 10 kilohertz are preferred since such frequencies are relatively easy to filter but are not high enough to be distorted by lead wire capacitances. Filter selection switch 89, discussed in more detail below, is operated in synchronism with selector switch 70 to properly select either 1 kilohertz filter 85 or 10 kilohertz filter 87 depending on the frequency of the AC signal generated by oscillator assembly 64.

The output of the Wien bridge oscillator 64 is connected to a level adjustment circuit, that is most preferably formed from a potentiometer 72 and an operational amplifier 74 having a feedback circuit that includes capacitor 75 and resistor 77. The provision of such a level adjustment mechanism in the oscillator assembly 44 can be used to allow the impedance monitoring circuit 42 to accommodate different types of probes having different operating impedances. Furthermore, such level adjustments can be used to ensure that minor variations in the output level of the AC signal from oscillator 64 are adjusted for.

The output of the oscillator assembly 44 is connected at output tap 50 to a rectification and smoothing circuit 54 which may include a half-wave rectifier in combination with smoothing capacitors. The rectification and smoothing circuit 54 produces rectified DC output on output lead 76. The voltage signal from output lead 76 corresponds to the voltage applied, or Va, of the circuit, and in this embodiment is connected to a panel meter (not shown) that uses the value of this voltage as a reference.

The output of the oscillator assembly 44 is also connected at output tap 50 to impedance circuit 46 via capacitor 79. The impedance circuit 46 is in turn serially connected to the circuit of a probe 21. The impedance circuit 46 comprises a selectable resistance circuit having a selector switch (not shown) for connecting either a 100 ohm, 510 ohm, 2 k-ohm or 10 k-ohm resistance to the capacitor 79. Of course, these resistor values are merely exemplary and other suitable resistance values could be employed depending on the suspected impedance of the probe circuit to be measured.

The purpose of the impedance circuit 46 is to provide a known impedance Zk to the AC voltage conducted through the circuit of a probe 21 so that the impedance and hence operating status of the probe circuit may be determined. The selectability of the resistances in the impedance circuit 46 accommodates the different operating impedances associated with different types of probes, as is explained in more detail hereinafter. It should be noted that the capacitor 79 also serves as a coupling capacitor with respect to the circuit of the probe 21 that prevents the transmission of any DC biasing currents to or from the circuit of probe 21.

The AC output of the impedance circuit 46 is serially connected to the circuit of the probe 21 through lead 82 relative to ground as indicated. In this manner, as can be seen from FIG. 3, known impedance 46 and the impedance of probe 21 are serially connected between oscillator 64 and ground. Therefore, known impedance 46 and the impedance of probe 21 form a voltage dividing circuit that operates to split the AC voltage generated by oscillator 64 depending on the relationship between known impedance 46 and the impedance of the probe 21. Voltage divider tap 56 is provided between known impedance 46 and probe 21, and allows a voltage corresponding to the voltage across probe 21 to be recovered. This voltage across probe 21 will include the AC voltage generated by oscillator 64 and dissipated across probe 21 as well as a DC component generated by probe 21 due to its normal operation. Accordingly, the total voltage present at tap 56 will include the combination of the AC and DC voltages as described above.

The combined signal formed by the output of the known impedance circuit 46 and the DC voltage output of the circuit of the probe 21 is connected via capacitor 57 to a band pass filter circuit 58 via voltage divider tap 56. In the preferred embodiment, circuit 58 includes parallel-connected 1 kilohertz and 10 kilohertz band pass filter and level adjust circuits 85, 87 respectively. A selector switch 89 is included to connect the output of either of the band pass filter and level adjust circuits 85, 87 to a rectifying and smoothing circuit 60, depending on whether the oscillator assembly 44 is generating either a 1 kilohertz or 10 kilohertz AC output. The band pass and level adjust circuits 85, 87 serve to remove any interfering frequencies that might be present in the combined signal due, for example, to voltages induced in the probe from an induction furnace. Furthermore, the capacitor 57 serves to reduce or remove a DC voltage component that is generated, for example, by probe 21. These circuits 85, 87 may be formed from a series of operational amplifiers in combination with tuned capacitors, or through known filter design methods and techniques readily apparent to one of skill in the art.

The output of the band pass filter circuit 58 is connected to another rectification and smoothing circuit 60 which converts the AC signal received into a smooth, DC potential that corresponds to the residual voltage, or Vr, of the probe circuit 21 being monitored. The residual voltage Vr generated at the output of the rectification and smoothing circuit 60 is connected to a probe status display circuit 91 that includes a threshold detection and LED driving circuit 93 whose output controls the actuation and deactuation of LED's indicating an "OK" operating status, and either a defectively high or low impedance status. The detector and LED driving circuit 93 preferably includes a microprocessor programmed to decide whether or not the residual voltage Vr received from the rectification and smoothing circuit 60 is within a range associated with a normal operating status of the probe 21, or is outside of this normal operating range. A Vr outside of the normal operating range may be indicative of an impedance indicating either an open circuit (high impedance) or closed circuit (low impedance) condition in the probe circuit. Depending upon the decision the microprocessor makes, either the "OK", "high", or "low" indicator LEDs are actuated to notify an operator of the status of the probe circuit 21.

In operation, the impedance monitoring circuit 42 is first connected to a circuit of a probe whose operability is to be monitored in the manner illustrated in FIG. 3. Next, the frequency of the Wien bridge oscillator 64 is selected by means of the switch 70 so that the oscillator 64 generates an AC signal having a frequency that is the least similar to ambient interfering frequencies. The impedance of the impedance circuit 46 is then adjusted by way of the selectable resistance circuit 81 so that the ratio of the voltages divided at tap 56 produces a residual voltage out of the rectification and smoothing circuit 60 which is perceived by the probe status display circuit 91 as indicative of an "OK" status assuming that the sensor is operable. The impedance monitoring circuit 42 may then continuously monitor the operability of the circuit of the probe to which it is connected. Any fluctuations in the impedance of the probe circuit will be reflected in a change in the residual voltage measured across probe circuit 21 and detected and displayed using display circuit 91.

As noted above, one primary feature of the present invention lies in the fact that probe status information can be monitored without affecting the DC signal generated by the probe. Such "passive" monitoring allows the probe condition to be continuously monitored while still allowing the probe to function in its intended manner. That is, since the present invention employs an AC signal to determine probe status information, a DC signal generated by the probe and used to measure a desired quantity or quality (such as the presence of slag, a temperature, or the amount of sulfur or oxygen) is unaffected. In this manner, the present invention is ideally suited for use with any number of probe circuits already installed and in use in that status monitoring can be added without replacement of the existing sensors.

Figure 4:
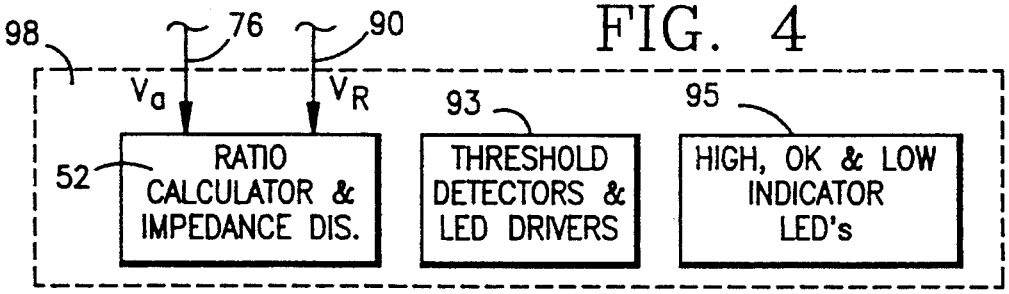
FIG. 4 is a partial schematic diagram of a second embodiment of the impedance monitoring circuit of the invention.

FIG. 4 illustrates a different embodiment of the probe system 40 of the invention that provides a more detailed measurement of the impedance of the probe whose operability is being measured, as well as its operational status. This embodiment is precisely the same as the embodiment described with respect to FIG. 3, with the exception that the probe status display circuit 98 includes a calculator circuit 52 for computing the ratio of the applied voltage Va from lead 76 and the residual voltage Vr from lead 90. Circuit 52 is generally comprised of a microprocessor in combination with a display panel. The output of the ratio calculator and impedance display circuit 52 is connected to a threshold detector and LED driver circuit 93, which in turn is connected to high, "OK", and low indicator LEDs 95 as was described with FIG. 3. The embodiment of the invention of FIG. 4 informs the system operator of the operative status of the probe circuit not only in the relative sense that the FIG. 3 embodiment does (which is sensitive only to a substantial change in an impedance associated with a normal operating condition), but further provides an absolute measurement of the impedance of the probe as well.

While this invention has been described with respect to two specific embodiments, numerous modifications, variations, and improvements will become evident to persons of ordinary skill in the instrumentation arts. All such modifications, revisions, and improvements are encompassed within the scope of this invention, which is limited only by the claims appended hereto.

What is claimed:

1. A system for monitoring a condition in a metallurgical process, comprising:

a probe having a circuit for generating a voltage signal indicative of a condition in a metallurgical process, wherein the magnitude of the voltage signal varies with changes in said condition, and impedance monitoring means electrically connected to said probe circuit for generating a signal indicative of the impedance of the probe circuit to determine the reliability of the probe voltage signal, including means for generating a signal indicative of an operating status of the probe circuit.

2. The monitoring system of claim 1, wherein the impedance monitoring means includes means electrically connecting said monitoring means to said probe circuit without transmitting a voltage from said probe circuit to said monitoring means to avoid disturbing the DC level of the probe circuit voltage signal.

3. The monitoring system of claim 2, wherein the impedance monitoring means is electrically connected to said probe circuit through a coupling capacitor to prevent a voltage from being transmitted from said impedance monitoring means to said probe circuit which would otherwise change the voltage signal of the probe circuit.

4. The monitoring system of claim 1, wherein the impedance monitoring means includes an oscillator means for generating an AC voltage, and a known impedance means, and said known impedance means is connected in series between said oscillator means and said probe circuit.

5. The monitoring system of claim 4, wherein the impedance monitoring circuit further includes a band pass filter means having an input connected between said known impedance means and said probe circuit for converting a voltage signal formed from a divided AC voltage of the oscillator means into a residual voltage.

6. The monitoring system of claim 5, wherein the impedance monitoring circuit further includes means for computing a ratio between the output voltage of the oscillator means, and the residual voltage generated by the band pass filter means in order to determine the impedance of the probe circuit.

7. The monitoring system of claim 6, wherein said ratio computing means includes means for converting said output and residual voltages from AC to DC.

8. The monitoring system of claim 1, wherein said probe is a slag detector whose voltage signal changes substantially upon an introduction of slag in a flow of molten metal.

9. The monitoring system of claim 1, wherein said probe is a thermocouple whose voltage signal varies with the temperature of metal in said metallurgical process.

10. The monitoring system of claim 1, wherein said probe is a sulfur detector whose voltage signal output varies with the proportion of sulfur within a liquid metal.

11. A system for monitoring a condition in a metallurgical process, comprising:

a probe having a circuit for generating a voltage signal indicative of a condition of a metal in a metallurgical process, wherein the magnitude of the voltage signal varies with changes in said condition, and impedance monitoring means electrically connected to said probe circuit through at least one coupling capacitor for continuously generating a signal indicative of the impedance of the probe circuit to determine the reliability of said signal without disturbing said signal, including a means for generating a signal indicative of an operating status of the probe circuit.

12. The monitoring system of claim 11, wherein the impedance monitoring means includes an oscillator means for generating an AC voltage having a frequency of between about 1 and 10 Khz.

13. The monitoring system of claim 12, wherein the impedance monitoring means further includes means for adjusting the peak voltage of said AC voltage.

14. The monitoring system of claim 12, wherein said impedance monitoring circuit further includes an impedance means of a selected impedance that is connected in series between said oscillator means and said probe circuit.

15. The monitoring system of claim 14, wherein said impedance means includes a plurality of selected impedances, and a switching means for connecting a single one of said known impedances in series between oscillator means and said probe circuit, depending upon the type of probe.

16. The monitoring system of claim 14, wherein the impedance monitoring circuit further includes a band pass filter means having an input connected between said known impedance means and said probe circuit for filtering out interfering frequencies, and for converting a voltage signal formed from a divided AC voltage of the oscillator means into a residual voltage.

17. The monitoring system of claim 16, wherein the impedance monitoring circuit further includes means for computing a ratio between the output voltage of the oscillator means, and the residual voltage generated by the band pass filter means in order to determine the impedance of the probe circuit, said ratio computing means including means for converting said output and residual voltages from AC to DC.

18. The monitoring system of claim 11, wherein said probe is a slag detector whose voltage signal changes substantially upon the introduction of slag in the flow of molten metal.

19. The monitoring system of claim 11, wherein said probe is a thermocouple whose voltage signal varies with the temperature of said metal.

20. The monitoring system of claim 11, wherein said probe is a sulphur detecting probe whose signal varies with the amount of sulphur present in a liquid metal.

21. The monitoring system of claim 11, wherein said probe is an oxygen detector probe whose signal varies with the amount of oxygen present in a liquid metal.

22. The monitoring system of claim 11, wherein said signal generating means includes a display means for visually displaying whether said probe circuit is properly operating.

* * * * *